US008844455B2

(12) United States Patent
Alshaikh et al.

(10) Patent No.: US 8,844,455 B2
(45) Date of Patent: Sep. 30, 2014

(54) BUOYED BIOMATS FOR RESERVOIR FLUID MANAGEMENT

(75) Inventors: Abdulmohsen Alshaikh, Riyadh (SA); Abdullah Ghazi M. Al-Rehaili, Alamadina Almonawara (SA); Saleh A. Alhasson, Riyadh (SA)

(73) Assignee: King Saud University, Riyadh (SA)

( * ) Notice: Subject to any disclaimer, the term of this patent is extended or adjusted under 35 U.S.C. 154(b) by 1122 days.

(21) Appl. No.: 12/830,352

(22) Filed: Jul. 4, 2010

(65) Prior Publication Data

US 2011/0000415 A1 Jan. 6, 2011

(30) Foreign Application Priority Data

Jul. 5, 2009 (SA) ..... 109300438

(51) Int. Cl.

| | |
|---|---|
| ***D05B 93/00*** | (2006.01) |
| ***B63B 35/00*** | (2006.01) |
| ***B65D 88/36*** | (2006.01) |
| *B32B 7/08* | (2006.01) |
| *B63B 35/44* | (2006.01) |
| *B63B 35/58* | (2006.01) |

(52) U.S. Cl.

CPC ..... *B63B 35/00* (2013.01); *B63B 2035/4493* (2013.01); *B65D 88/36* (2013.01); *B63B 35/58* (2013.01)

USPC ..... 112/475.08; 112/402; 112/420; 422/43

(58) Field of Classification Search

CPC ..... D03D 1/00; D05B 1/00; D05B 93/00; D04H 1/52; D01H 1/26; D01H 1/426; D01H 1/4266; D01H 3/077; B01D 24/04; B65D 90/42; B01J 19/16; E02B 3/04; B32B 7/08

USPC ..... 112/400, 402, 416, 420, 475.08; 210/242.1; 422/42, 43; 405/63

See application file for complete search history.

(56) References Cited

U.S. PATENT DOCUMENTS

| | | | | |
|---|---|---|---|---|
| 3,459,492 | A * | 8/1969 | Cawley et al. | 422/43 |
| 3,815,367 | A * | 6/1974 | Collins et al. | 405/52 |
| 3,998,204 | A | 12/1976 | Fuchs et al. | |
| 4,066,400 | A * | 1/1978 | Cox et al. | 422/43 |
| 4,173,043 | A * | 11/1979 | Vernon | 4/502 |
| 4,749,606 | A | 6/1988 | Moore | |
| 5,125,355 | A | 6/1992 | Stranzinger | |
| 5,871,303 | A * | 2/1999 | Brown et al. | 405/24 |
| 5,961,823 | A * | 10/1999 | Alper | 210/198.1 |
| 6,673,241 | B1 * | 1/2004 | Tung et al. | 210/242.1 |
| 6,932,540 | B2 * | 8/2005 | Svirklys et al. | 405/52 |
| 7,387,473 | B2 | 6/2008 | Smith | |
| 2007/0253785 | A1 * | 11/2007 | Tyler | 405/302.6 |
| 2009/0103981 | A1 * | 4/2009 | Tagini | 405/114 |

OTHER PUBLICATIONS

Khan et al.; "Evaporation reduction in stock tanks for increasing water supplies," Journal of Hydrology, 1990; 119(1-4):21-29.

* cited by examiner

*Primary Examiner* — Ismael Izaguirre

(74) *Attorney, Agent, or Firm* — James A. Sheridan

(57) ABSTRACT

Buoyed mats for reservoir vapor management are described. In one aspect, the buoyed biomats are made from an interconnected structure comprising biomass materials. A support structure is attached to the interconnected biomass. Floatable components are attached to the support structure to facilitate flotation of the mats.

18 Claims, 3 Drawing Sheets

BUOYED BIOMATS FOR RESERVOIR FLUID MANAGEMENT

RELATED APPLICATIONS

This patent application claims priority to Saudi Arabian Patent Application Serial No. 109300438, filed on Jul. 05, 2009, titled "Mats Made of Date Trees' Leaves to Minimize Water Vaporization from Exposed Water Reservoirs", and which is hereby incorporated in its entirety by reference.

BACKGROUND

Fluid loss from reservoirs is generally of substantial concern to the public and industry. For example, loss of substantial amounts of water from a reservoir through evaporation may considerably reduce the amount of water that is available to meet the basic human needs of the public sphere in a region. Additionally, certain industries require substantial amount of water for operations. Reduction of the amount of water available to such an industry may affect the viability of the industry to operate in that region. Water loss from reservoirs is especially problematic in regions with arid weather or that are experiencing drought conditions.

SUMMARY

Buoyed mats for reservoir vapor management are described. In one aspect, the buoyed biomats are made from an interconnected structure comprising biomass materials. A support structure is attached to the interconnected biomass. Floatable components are attached to the support structure to facilitate flotation of the mats.

This Summary is provided to introduce a selection of concepts in a simplified form that are further described below in the detailed description. This Summary is not intended to identify key features or essential features of the claimed subject matter, nor is it intended to be used as an aid in determining the scope of the claimed subject matter.

BRIEF DESCRIPTION OF THE DRAWINGS

Systems and methods for an buoyed biomats for reservoir fluid management are described with reference to the accompanying drawings.

DETAILED DESCRIPTION

Overview

Buoyed biomats for reservoir fluid management facilitate reduction of reservoir water vaporization by using date trees leaves as webbing in the shape of a mat. In one exemplary implementation, the dimension of each biomat has dimensions of 1×1 m (length and width), although other dimensions could be used as required by the particular reservoir configuration. As described below, the biomats are operatively coupled to floating objects such as buoys to help the mat float on the water. In one implementation, substantially the entire reservoir surface, or other portion of the reservoir, can be covered with adjoining, or otherwise closely positioned, biomats. Such placement substantially reduces the amount of water vaporization from corresponding portions of the biomat-covered reservoir.

Conventional systems use bamboo to reduce evaporation in stock tanks. Such standard systems prevent vaporization to the same degree as the described systems and methods for buoyed biomats for reservoir fluid management, for example, due to the substantially large gaps created when bamboo canes are stacked next to one another. In contrast, one exemplary implementation of systems and methods for buoyed biomats (e.g., for reservoir fluid management) use date tree leaves, when webbed together, that substantially minimizes such gaps, which in turn, facilitates limitation of fungus growth on the water surface. These and other novel aspects of the systems and methods for buoyed biomats for reservoir fluid management are now described in greater detail.

Exemplary Systems And Methods

Figure 1:
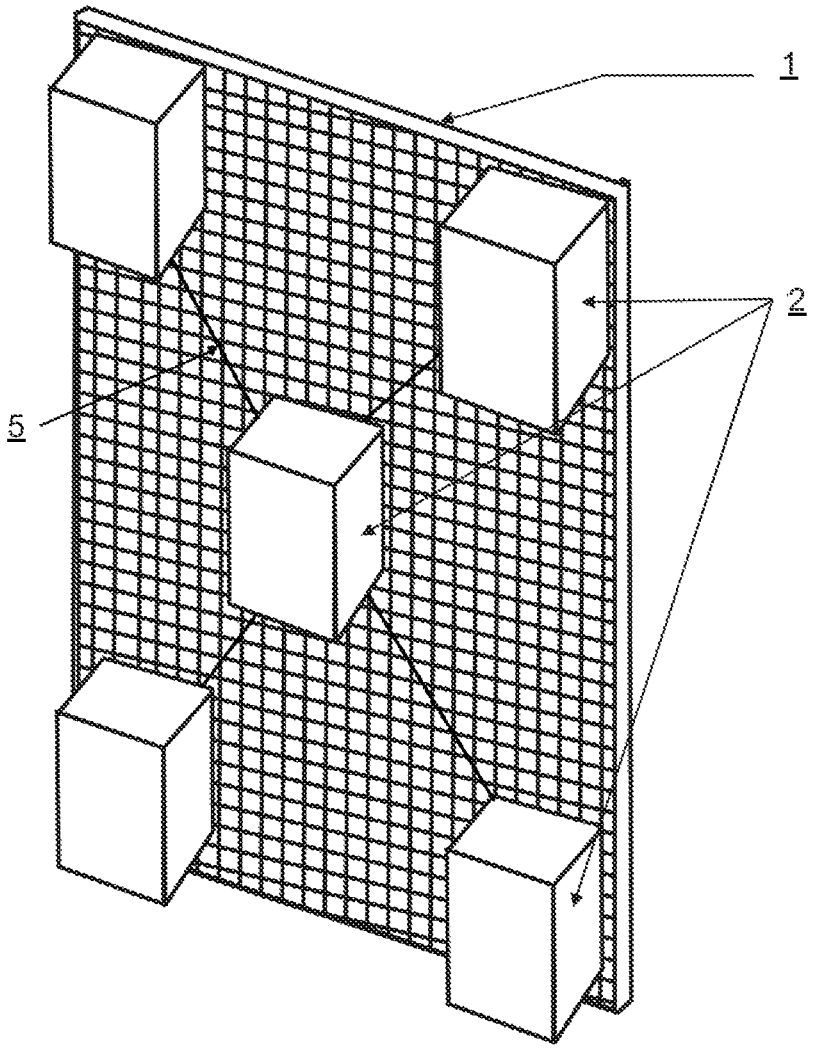
FIG. 1 shows an exemplary bottom view for webbing of date tree leaves mounted on an assisting floating platform, according to one embodiment.
Figure 2:
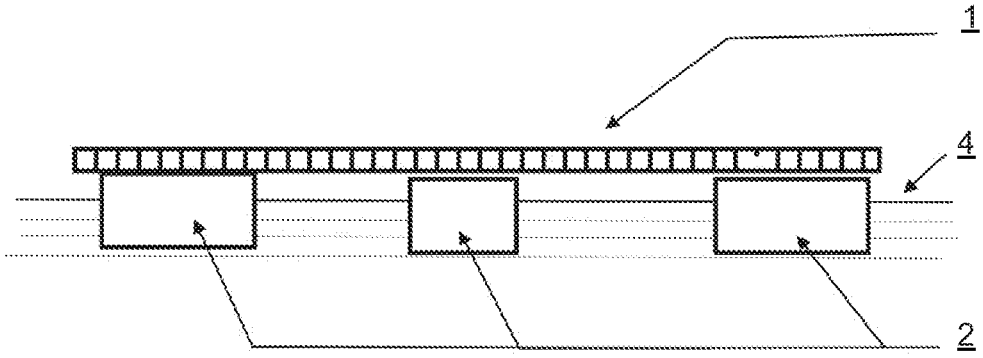
FIG. 2 shows an exemplary side view for the webbing, and it shows the assisting floating platforms under it, according to one embodiment.

FIGS. 1 and 2 show an exemplary mat 1 knitted (webbed) from date trees' leaves. FIG. 1 shows an exemplary bottom view of a biomass mat, for example, as it would appear from underneath while it was floating on water 4 (FIG. 2). FIG. 2 shows an exemplary side view of a biomass mat. In this particular implementation, the dimensions of a biomass mat are 1×1 m. In other implementations, the dimensions of the biomass mat are different. As illustrated, the mats webbed (knitted) of date trees' leaves 1 are mounted on buoys (buoyants) 2 which assist flotation of the biomass mat on the surface of a reservoir. In one implementation, the buoys are made of buoyant plastic, cork, and/or so on, or combinations of these materials. In this particular implementation, the web mat 1 is provided with support via a set of crossbars (supporters) 5. In this exemplary illustration, the supporters are positioned diagonally with respect to one another substantially to prevent the center of mat 1 from drooping to the water surface 4 (FIG. 2). In this particular implementation, the center of the biomass mat 1 is supported with a buoyant 2 in the area of supporter components 5 intersection. As dimensions of the biomass mat increase, the combination of larger and/or more numerous buoys 2 are used to provide flotation to the biomass mat. In one implementation, the supporters 5 are made from strong date trees' branches. In another implementation, the supporters 5 are made from other natural elements.

Figure 3:
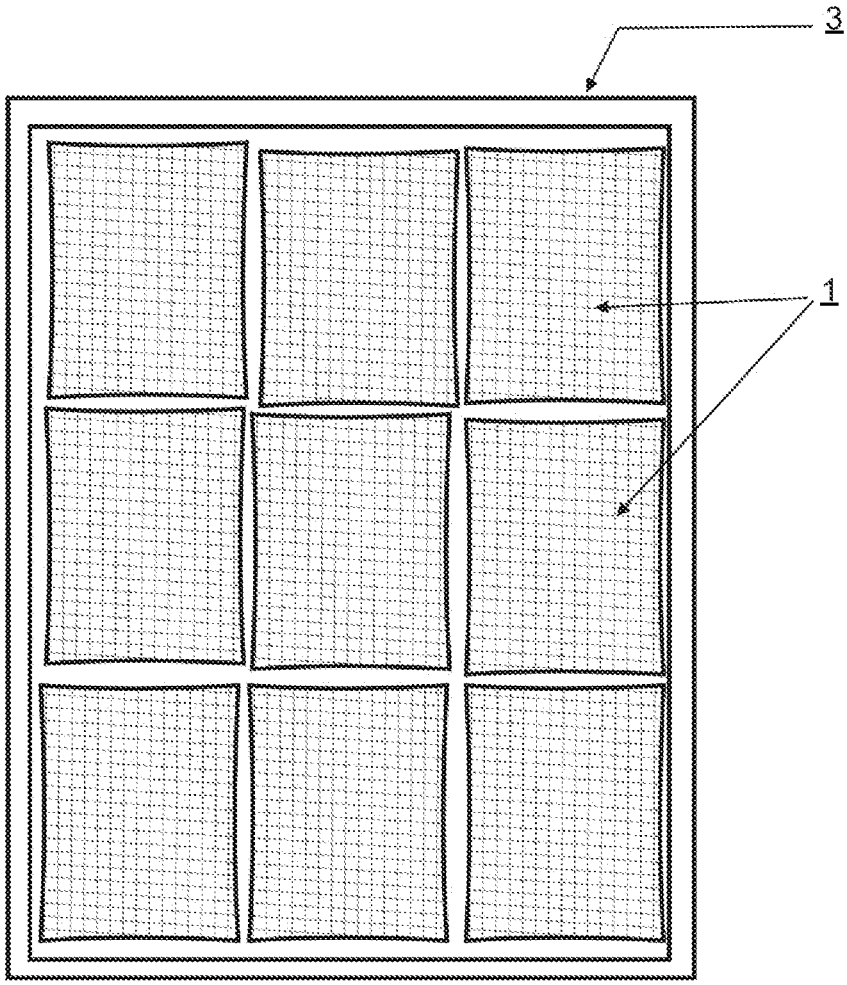
FIG. 3 shows an exemplary top view for a group of adjoining mats lined together on the surface of an open reservoir, according to one embodiment.

FIG. 3 shows an exemplary system for comprising a set of biomass mats 1, according to one embodiment. In this particular example, the multiple biomass mats are horizontally and vertically in parallel, adjacent to one another, one a fluid (i.e., water) surface in a reservoir 3. Any number of biomass mats can be utilized to manage evaporation of fluid from a reservoir 3 as a function of the particular shape and size of the reservoir and the shapes and sizes of respective ones of the biomass mats 1.

TABLE 1 shows a set of exemplary ratios of reduced water vaporization in fully and partially covered reservoirs 3, as compared to the same reservoirs being without the described biomass mats and exposed to air, sunlight, winds, etc. As shown, biomass mats 1 spread over the water surface 4 in water reservoirs 3 have led to a substantial reduction of water vaporization.

TABLE 1

Exemplary Comparison of Vaporization Ratio of Reservoirs Substantially Fully Covered with Biomass Mats 1, Semi Covered, or Devoid of Biomass Mats

| Ratio of saving % | | Average rate of evaporation (depth of lost water in mm) | | | Average | |
|---|---|---|---|---|---|---|
| Semi covered | Fully covered | exposed | semi covered | Fully covered | temperature (centigrade) | Time interval (number of days) |
| 24.56 | 63.16 | 5.7 | 4.3 | 2.1 | 25.4 | 22/03 to 01/04/2009 (10) |
| 28.41 | 65.91 | 6.2 | 4.5 | 2.1 | 31 | 5/04 to 19/04 19/04/2009 (14) |
| 28 | 60 | 8.3 | 6 | 3.3 | 34.8 | 22/4 to 4/5/2009 (12) |
| 27.42 | 61.29 | 8.9 | 6.4 | 3.4 | 33.7 | 6 to 13/5/2009 (7) |
| 25.45 | 56.36 | 10 | 7.5 | 4.4 | 36.7 | 23/5 to 3/6/2009 (10) |
| 23.73 | 52.54 | 8.4 | 6.4 | 4 | 39.5 | 6 to 13/6/2009 (6) |
| 26.30 | 59.90 | average | | | | |

TABLE 2 shows exemplary reduction of heat temperature in the gap between biomass mats 1 (FIG. 1) and water surface 4 (FIG. 2). As illustrated in exemplary TABLE 2, use of biomass mats may reduce heat temperature in the gaps between the mats by a ratio of approximately 13%, as compared to temperature above the mats 1. This use of the mats substantially reduces vaporization rates, for example, as shown in TABLE 2.

TABLE 2

| Percentage of temperature reduction % | Temperature under the mats, (centigrade) | Atmosphere temperature (Centigrade) | Date and time |
|---|---|---|---|
| 6.45 | 29 | 31 | 26/5/2009 08:48 |
| 9.46 | 28.7 | 31.7 | 18/5/2009 08:59 |
| 12.6 | 31.9 | 36.5 | 20/5/2009 09:15 |
| 14.49 | 36 | 42.1 | 23/5/2009 09:20 |
| 14.29 | 33 | 38.5 | 25/5/2009 08:03 |
| 11.51 | 34.6 | 39.1 | 27/5/2009 09:00 |
| 16.92 | 27.5 | 33.1 | 30/5/2009 07:44 |
| 13.11 | 28.5 | 32.8 | 1/6/2009 08:15 |
| 17.05 | 28.7 | 34.6 | 3/6/2009 08:40 |
| 13.09 | 31.2 | 35.9 | 6/6/2009 09:02 |
| 9.57 | 34 | 37.6 | 8/6/2009 10:15 |
| 12.82 | 37.4 | 42.9 | 10/6/2009 10:06 |
| 13.49 | 35.9 | 41.5 | 13/6/2009 09:03 |
| 12.68 | average | | |

Conclusion

Although the above sections describe systems and methods for a Buoyed Biomats for Reservoir Fluid Management in language specific to structural features, the implementations defined in the appended claims are not necessarily limited to the specific described features. Rather, the specific features are disclosed as exemplary forms of implementing the claimed subject matter.

The invention claimed is:

1. A floatable mat for reservoir vapor management, the mat comprising:

interconnected biomass forming a upper-level structure having an upper surface and a lower surface in opposition to one another;

a support forming a mid-level structure attached to the lower surface of the structure of the interconnected biomass, and the mid-level structure of the support extending below the lower surface of the structure of the interconnected biomass; and a floatable member forming a lower-level structure having a lower portion and an upper portion, the floatable member attached to the support, the lower-level structure of the floatable member having a height between the lower portion and the upper portion, and the height of the floatable member and the support configured to maintain the interconnected biomass above to a reservoir surface.

2. The mat of claim 1 wherein the biomass comprises one or more of date tree leaves and palm tree leaves.

3. The mat of claim 1 wherein the interconnected biomass comprises biomass that is sewn together.

4. The mat of claim 1 wherein the interconnected biomass comprises biomass that is webbed together.

5. The mat of claim 1 wherein the floatable member comprises one or more of wood, cork, rubber, plastic, and biomass.

6. The mat of claim 1 wherein the support comprises a solid member lattice.

7. The mat of claim 1 wherein the support comprises one or more of tree branches, bamboo, and rods.

8. A method of preparing a floatable biomass mat for reservoir vapor management, the method comprising:

conditioning the biomass;

interconnecting the biomass to form a upper-level structure having an upper surface and a lower surface in opposition to one another;

attaching the interconnected biomass to a support, wherein the support forms a mid-level structure attached to the lower surface of the upper-level structure of the interconnected biomass, and the mid-level structure of the support extending below the lower surface of the upper-level structure of the interconnected biomass; and attaching a floatable member to the support, wherein the floatable member forms a lower-level structure having a lower portion and an upper portion, wherein the floatable member is attached to the support, wherein the lower-level structure of the floatable member has a height between the lower portion and the upper portion, and wherein the height of the floatable member and the support are configured to maintain the interconnected biomass above to a reservoir surface.

9. The method of claim 8 wherein the conditioning comprises trimming the biomass.

10. The method of claim 8 wherein interconnecting the biomass comprises sewing the biomass.

11. The method of claim 8 wherein interconnecting the biomass comprises webbing the biomass.

12. A floatable mat for reservoir vapor management, the mat comprising:

interconnected biomass forming a upper-level structure having an upper surface and a lower surface in opposition to one another;

a support forming a mid-level structure attached to the lower surface of the structure of the interconnected biomass, and the mid-level structure of the support extending below the lower surface of the structure of the interconnected biomass; and a plurality of floatable members forming a lower-level structure having a lower portion and an upper portion, the plurality of floatable members attached to the support, the lower-level structure of the floatable members having a height between the lower portion and the upper portion, the height of the floatable members and the support configured to maintain the interconnected biomass above to a reservoir surface, and each of the plurality of floatable members connected to at least another one of the plurality of floatable members with a portion of the mid-level structure of the support.

13. The mat of claim 12 wherein the biomass comprises one or more of date tree leaves and palm tree leaves.

14. The mat of claim 12 wherein the interconnected biomass comprises biomass that is sewn together.

15. The mat of claim 12 wherein the interconnected biomass comprises biomass that is webbed together.

16. The mat of claim 12 wherein the floatable member comprises one or more of wood, cork, rubber, plastic, and biomass.

17. The mat of claim 12 wherein the support comprises a solid member lattice.

18. The mat of claim 12 wherein the support comprises one or more of tree branches, bamboo, and rods.

* * * * *